US009341348B2

(12) United States Patent
Keser et al.

(10) Patent No.: US 9,341,348 B2
(45) Date of Patent: May 17, 2016

(54) LIGHTING ASSEMBLY AND SOCKET

(75) Inventors: Merijn Keser, Eindhoven (NL); Peter Hubertus Franciscus Deurenberg, s-Hertogenbosch (NL); Martinus Petrus Creusen, Wijlre (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 38 days.

(21) Appl. No.: 14/111,900

(22) PCT Filed: Apr. 3, 2012

(86) PCT No.: PCT/IB2012/051618

§ 371 (c)(1),
(2), (4) Date: Oct. 15, 2013

(87) PCT Pub. No.: WO2012/143810

PCT Pub. Date: Oct. 26, 2012

(65) Prior Publication Data

US 2014/0036474 A1 Feb. 6, 2014

(30) Foreign Application Priority Data

Apr. 21, 2011 (EP) ..... 11163352

(51) Int. Cl.
*F21V 29/00* (2015.01)
*F21V 19/00* (2006.01)
(Continued)

(52) U.S. Cl.
CPC ..... *F21V 19/001* (2013.01); *F21K 9/30* (2013.01); *F21V 19/0005* (2013.01);
(Continued)

(58) Field of Classification Search
CPC ..... F21V 15/011; F21V 13/06; F21V 29/004; F21V 19/0065; F21V 19/045; F21V 19/0055; F21V 17/12; F21V 15/005; F21V 15/02; F21V 15/06; F21V 8/02
USPC ..... 362/294, 364, 365, 373, 362
See application file for complete search history.

(56) References Cited

U.S. PATENT DOCUMENTS 5,213,408 A * 5/1993 Shiau ..... 362/187
5,593,324 A * 1/1997 Ito ..... 439/672
(Continued)

FOREIGN PATENT DOCUMENTS

CN 201066101 Y 5/2008
DE 102007041126 A1 3/2009
(Continued)

*Primary Examiner* — Evan Dzierzynski
*Assistant Examiner* — Matthew Peerce

(57) ABSTRACT

A lighting assembly (100) configured to be mechanically and electrically connected to a socket (150), the lighting assembly comprising a lighting module (102) comprising a light source (106), electrical contacting means (108) electrically connected to the light source and a heat spreader (110) in thermal contact with the light source; and a connector (104) being rotatable in relation to the lighting module (102). The connector comprises connector locking means (119) for locking the lighting assembly to a socket through interaction with receiving locking means comprised in the socket when the lighting module is axially inserted into the socket and the connector is rotated relative to the lighting module and the socket, thereby bringing the electrical contacting means (108) into contact with corresponding receiving contacting means (122) comprised in the socket. Hereby, the space required for electrical contacting means in the lighting assembly and in the socket may be reduced as no space is reserved in the socket for rotation of the electrical connecting means.

11 Claims, 3 Drawing Sheets

(51) Int. Cl.

| | |
|---|---|
| ***F21K 99/00*** | (2016.01) |
| ***F21V 23/00*** | (2015.01) |
| ***F21V 23/06*** | (2006.01) |
| ***F21V 29/71*** | (2015.01) |
| ***F21V 29/76*** | (2015.01) |
| *F21Y 101/02* | (2006.01) |
| *H01R 33/945* | (2006.01) |
| *F21V 29/70* | (2015.01) |

(52) U.S. Cl.

CPC ..... *F21V 23/005* (2013.01); *F21V 23/06* (2013.01); *F21V 29/713* (2015.01); *F21V 29/763* (2015.01); *F21V 29/70* (2015.01); *F21Y 2101/02* (2013.01); *F21Y 2101/025* (2013.01); *H01R 33/9456* (2013.01)

(56) References Cited

U.S. PATENT DOCUMENTS

| | | | | |
|---|---|---|---|---|
| 6,039,460 | A * | 3/2000 | Ng et al. | 362/267 |
| 7,347,706 | B1 * | 3/2008 | Wu et al. | 439/320 |
| 7,484,863 | B1 * | 2/2009 | Aubrey | 362/294 |
| 7,703,951 | B2 * | 4/2010 | Piepgras et al. | 362/373 |
| 8,125,776 | B2 * | 2/2012 | Alexander et al. | 361/688 |
| 8,657,464 | B2 * | 2/2014 | Lundberg et al. | 362/232 |
| 8,657,470 | B2 * | 2/2014 | Jen et al. | 362/285 |
| 2004/0213005 | A1 * | 10/2004 | Kohlmeier-Beckmann et al. | 362/471 |
| 2005/0122713 | A1 * | 6/2005 | Hutchins | 362/205 |
| 2005/0254246 | A1 * | 11/2005 | Huang | 362/362 |
| 2010/0096992 | A1 * | 4/2010 | Yamamoto et al. | 315/112 |
| 2011/0128730 | A1 * | 6/2011 | Chiu | 362/235 |
| 2012/0051068 | A1 * | 3/2012 | Pelton et al. | 362/373 |
| 2012/0206921 | A1 * | 8/2012 | Chang et al. | 362/311.02 |
| 2012/0218748 | A1 * | 8/2012 | Conrad | 362/230 |
| 2012/0314429 | A1 * | 12/2012 | Plunk | 362/374 |
| 2013/0063945 | A1 * | 3/2013 | Wu et al. | 362/249.02 |

FOREIGN PATENT DOCUMENTS

| | | | |
|---|---|---|---|
| EP | 2284440 | A1 | 2/2011 |
| WO | 2010146509 | A1 | 12/2010 |
| WO | 2010146513 | A1 | 12/2010 |
| WO | WO2011037655 | | 3/2011 |
| WO | 2012052870 | A1 | 4/2012 |

* cited by examiner

LIGHTING ASSEMBLY AND SOCKET

FIELD OF THE INVENTION

The invention relates to a lighting assembly and to a socket for receiving the lighting assembly.

BACKGROUND OF THE INVENTION

Light emitting diodes, LEDs, are employed in a wide range of lighting applications. As LEDs have the advantage of providing a bright light, being reasonably inexpensive and drawing very little power, it is becoming increasingly attractive to use LEDs as an alternative to traditional incandescent lighting. Furthermore, LEDs have a long operational lifetime. As an example, LED lamps may last 100 000 hours which is up to 20 times the operational life of an incandescent lamp.

However, even though LEDs have a long operational life, individual devices may fail and require early replacement or LED lamps may be replaced for reasons such as upgrading or alternating between different LED lamps.

Therefore, serviceable and integrated LED modules with corresponding sockets for general lighting applications are introduced to the market, thereby enabling easy upgrades and replacability of LED modules. Additionally, a modular system for LED devices provides the possibility to use LED modules from different suppliers.

U.S. Pat. No. 7,703,951 discloses a lighting fixture including a housing that is configured to be recessed into or otherwise disposed behind an architectural surface such as a ceiling, a wall, or a soffit, in new or existing construction scenarios. The fixture housing includes a socket configured to facilitate one or more of a mechanical, electrical and thermal coupling of a light-generating module to the fixture housing. The ability to easily engage and disengage a LED-based light-generating module with the socket, without removing the fixture housing itself, allows for straightforward replacement of the LED module upon failure, or exchange with another module having different light-generating characteristics. As an example, the LED modules may be replaced and upgraded at the end of their operational life, or earlier, if e.g. a different color temperature is desired, without having to remove the reflector or open the ceiling.

Alternative designs of a LED system comprising a socket and a LED module may be of interest such that a more compact LED system is provided. In a more compact LED system, or in a system where LED devices are densely packed, higher demands may be put on the heat-dissipation properties of the system as heat generated from the LEDs must be efficiently dissipated in order to maintain the required performance of the LEDs. Accordingly, there may be a need for improved LED modules and corresponding sockets for providing more compact devices and/or for improving performance characteristics.

SUMMARY OF THE INVENTION

It is an object of the present invention to provide an improved lighting assembly and a socket for releasably connecting the lighting assembly to the socket in a reliable way.

According to a first aspect of the invention, this and other objects are achieved by a lighting assembly configured to be mechanically and electrically connected to a socket, the lighting assembly comprising: a lighting module comprising a light source, electrical contacting means electrically connected to the light source and a heat spreader in thermal contact with the light source; and a connector being rotatable in relation to the lighting module and comprising connector locking means for locking the lighting assembly to a socket through interaction with receiving locking means comprised in the socket when the lighting module is axially inserted into the socket and the connector is rotated relative to the lighting module and the socket, thereby bringing the electrical contacting means into contact with corresponding receiving contacting means comprised in the socket.

The term "axially inserted" should in the present context be understood in relation to an axial direction of the lighting assembly and/or the socket. The axial direction is in the present context defined as a direction substantially perpendicular to a radius of a generally circular cross-section of the connector and/or the socket. In the case of a substantially cylindrical lighting assembly and/or socket, the axial direction corresponds to the normal to a circular cross-section plane of the lighting assembly and/or socket.

Electronics for controlling the light source may also be comprised in the lighting module. Control features may for example include dimming and/or color control of the light source. The controlling electronics and the light source may for example be mounted on a circuit board arranged on an upper surface of the lighting module. However, the lighting assembly may equally well comprise a lighting module where the controlling electronics are integrated in the module. The lighting assembly may further comprise a reflector for reflecting the light in a desired manner.

In the present context, the electrical contacting means may for example be electrically conductive connector pins for providing power to the light source. Furthermore, the electrical contacting means may also comprise contacts for control of and communication with the lighting module. However, the electrical contacting means may also comprise different electrical contacts such as connectors or battery contacts.

The heat spreader may be a metallic plate providing good thermal conductivity for efficient transfer of heat generated by the light source. However, alternative designs of the heat spreader and other materials compositions providing sufficient thermal conductivity may also be used such as metal alloys, thermal epoxy, diamond or other carbon based materials.

The lighting module may also comprise guiding features for guiding the rotational and axial movement of the connector in relation to the lighting module. Such guiding features may for example be guiding slots in which corresponding pegs on the connector may travel.

The present invention is based on the realization that by inserting the electrical contacting means in an axial direction while locking the lighting assembly to the socket by rotating the connector in relation to the lighting module and the socket, the space required for electrical contacting means in the lighting assembly and in the socket may be reduced as no space is reserved in the socket for rotation of the electrical connecting means. The receiving contacting means in the socket for reception of the electrical connecting means in an axial direction may be made smaller than corresponding receiving contacting means for rotational reception of electrical connecting means, thereby providing improved space utilization in the lighting assembly and in the socket. Contrary to many of the lighting assemblies known from prior art where both the electrical and mechanical connection has been achieved through a rotational motion of the lighting assembly, the lighting assembly according to the present invention comprises a connector which is rotational in relation to the lighting module, thereby enabling a rotational mechanical locking of the connector while vertically inserting the electrical contacting means and the heat spreader into the socket.

An advantage of the improved space utilization is that a larger portion of the cross-section area may be used by the heat spreader, thereby improving heat dissipation from the light source. Alternatively, the improved space utilization may be used to reduce the size of the connector and socket while maintaining a certain level of heat dissipation. Furthermore, as the heat-spreader is vertically inserted into the socket, the heat-spreader need not have a circular cross-section. An advantage of shedding that limitation is that additional flexibility is provided in designing the heat-spreader for the best possible heat dissipation properties. Additionally, by using a non-circular heat spreader the heat spreader and socket may be designed so as to provide visual guidance regarding how the lighting assembly should be mounted in the socket. An additional advantage of a lighting assembly according to the present invention is that the lighting module may easily be replaced without replacing the entire lighting assembly.

According to one embodiment of the invention, the connector may further comprise spring means arranged and configured to apply a mechanical force on the heat spreader in an axial direction so as to form a thermal contact between the heat spreader and a heat sink comprised in the socket. Here, the connector is movable in an axial direction in relation to the lighting module such that a force is applied in the axial direction from the connector onto the heat spreader while the connector is rotatably mounted in the socket. By applying a mechanical force on the heat spreader such that it is pressed against the heat sink, the thermal interface may be improved, thereby improving the heat dissipation from the heat spreader to the heat sink. Furthermore, by arranging the spring means in the connector so that the force is applied directly onto the heat spreader in an axial direction, additional space is saved in the connector and the socket, allowing for a larger surface area of the heat spreader. The spring means may for example comprise one or more leaf springs attached to the connector in such a way that a mechanical force is acting on the heat spreader in an axial direction as the connector is rotated in relation to the lighting module when mounting of the lighting assembly in the socket. However, the spring means may equally well be for example coil springs or any other flexible arrangement performing the task of applying a force on the heat spreader as the lighting assembly is mounted in a socket. The spring means are preferably located such that forces generated by them have to travel a short way through the components to the fixed portions of the socket. This means they should be placed close to or on to the heat spreader, and close to the connector locking means that transfer the forces from the connector to the socket and further to the heat sink. Furthermore, spring means may be arranged between the connector and the lighting module in the rotational direction so as to maintain their relative rotational position in a correct starting position for installment. The rotationally arranged spring means should not apply a rotational force which is larger than the forces holding the connector in the socket in a mounted position.

According to one embodiment, the electrical connection between the lighting module and the socket may be achieved through the rotation of the connector and the resulting axial movement of the electrical contacting means such that no electrical connection is made unless the heat spreader is in thermal contact with the heat sink comprised in the socket. As the connector and socket are configured so that the lighting module is installed by simultaneous rotation and axial movement, too early electrical contact is prevented. If the electrical contact would be made before the lighting module is fully installed, the thermal contact may not yet be completely formed, thereby risking early failure of the lighting module due to bad thermal contact and consequently low heat dissipation from the lighting module.

In one embodiment, the light source may advantageously be one or more light emitting diodes (LEDs). LEDs may advantageously be selected over other light sources as they are a cost-efficient alternative as a result of low power consumption and long operational lifetime. Furthermore, as LEDs can be made small the overall size of the lighting assembly may be reduced in comparison with lighting assemblies using incandescent light sources.

In one embodiment, the connector locking means may advantageously be the first part of a bayonet coupling. A bayonet coupling providing the "twist and lock" functionality may be regarded as the most intuitive way to mount a lighting assembly in a socket. Alternatively, other connector locking means such as for example screw threads are equally feasible.

According to a second aspect of the invention, it is provided a socket for receiving the aforementioned lighting assembly, the socket comprising: a collar shaped portion comprising receiving locking means configured to interact with the connector locking means for locking the connector to the socket, receiving contacting means for axially receiving the electrical contacting means, and a heat sink configured to form a thermal contact to the heat spreader. The receiving contacting means are adapted to receive the electrical contacting means of the lighting module. Analogously to in the lighting module, the receiving contacting means in the socket may be configured in different ways, such as recesses for receiving connector pins or any other corresponding arrangement adapted to form a conductive path between the light source and the socket. The collar shaped portion may advantageously be made from an electrically insulating material such as plastic or a ceramic material.

As both the performance and the lifetime of an LED is strongly dependent on the operating temperature, it is important to provide efficient cooling of the light source. Efficient cooling may advantageously be facilitated by the heat sink which is configured to dissipate the heat which is generated by the light source and transferred to the heat sink via the heat spreader. Therefore, it is important to have a good thermal contact at the interface between the heat spreader and the heat sink. In particular, the thermal interface may advantageously comprise a layer of a material configured to improve the thermal contact, a thermal interface material (TIM). The thermal interface material may advantageously be provided in the form of a paste allowing the thermal interface to form around surface irregularities such as particle contamination. However, the thermal interface material may equally well be a thermally conductive tape or any other material providing high thermal conductivity and a good thermal interface and which improves the exchangeability of the lighting module. A further advantage of the lighting assembly according to the present invention is that there is more freedom in the choice of TIM compared to what may be used in bayonet-type LED sockets where the heat spreader is rotated as it is brought into contact with the heat sink. In particular, the TIM used in the present lighting assembly does not need a special liner or be otherwise adapted to endure a rotational movement under pressure.

The heat sink is preferably made from a material having a high thermal conductivity, for example a metal. It may also preferably be designed comprising one or more fins or flanges for transferring heat to the surrounding air. The heat sink may also be part of an active cooling system using for example a fan for circulating air around the fins of the heat sink.

According to one embodiment, the collar shaped portion may be mechanically connected to the heat sink. The collar shaped portion may for example be provided with holes for screwing to the heat sink. Alternatively, the collar shaped portion may be clamped or glued to the heat sink, or it may be an integrated portion of the heat sink.

In one embodiment, the collar shaped portion is arranged along the circumference of the socket. Furthermore, the electrical receiving means may be arranged in the collar shaped portion.

According to one embodiment, the receiving locking means may advantageously be a second part of a bayonet coupling. However, the receiving locking means may alternatively be screw threads for receiving corresponding screw threads of the connector or any other means cooperating to provide a mechanical coupling.

The aforementioned lighting assembly may advantageously be mounted in a socket, the combination thereby forming a luminaire. The socket may preferably be connected to a power supply such as a mains connection, a battery or any other suitable power source.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
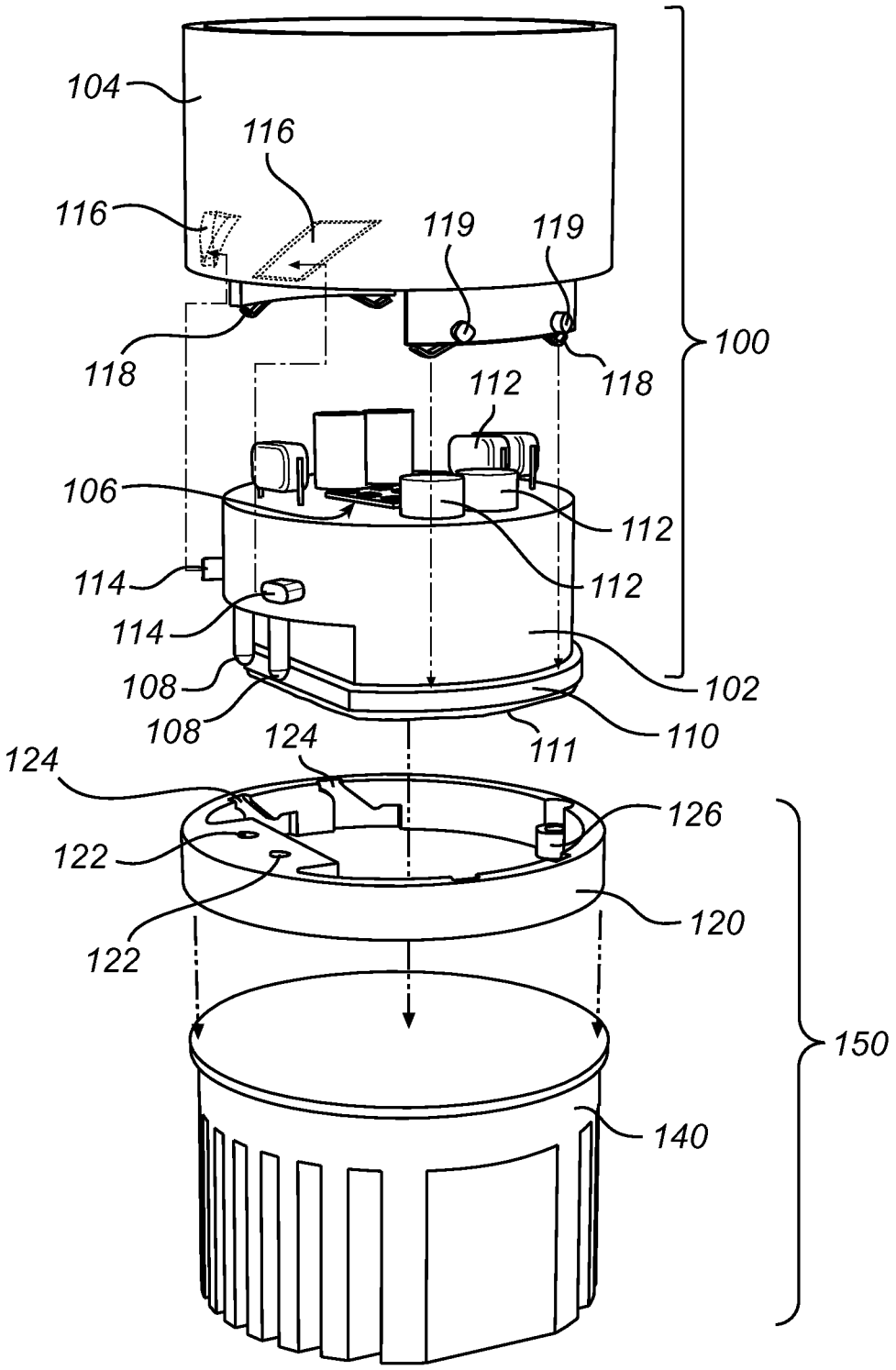
FIG. 1 schematically illustrates a lighting assembly according to an embodiment of the present invention.

The present invention will now be described more fully hereinafter with reference to the accompanying drawings, in which example embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

In the following detailed description, example embodiments of a lighting assembly according to the present invention are mainly discussed with reference to FIG. 1 illustrating a lighting assembly configured to be mechanically and electrically connected to a socket and a socket configured to receive the lighting assembly.

FIG. 1 schematically illustrates a lighting assembly 100 comprising a lighting module 102 and a connector 104 configured to be connected to the socket 150 comprising a collar shaped portion 120 and a heat sink 140. The lighting module 102 comprises a LED light source 106, electrical contacting means 108 in the form of electrically conductive connector pins 108 connected to the LED 104 and a heat spreader 110 which is in thermal contact with the LED 106. In the present example, the electrically conductive connector pins 108 are configured to provide contact to a power source. A layer of thermal interface material (TIM) 111 is arranged on the heat spreader 110 on the side facing the heat sink 140. The heat sink 140 is provided with fins for efficient transfer of heat from the heat sink 140 to the surrounding air.

The lighting module 102 is further equipped with electronics 112 for controlling the LED 104. The connector 104 is shaped as an essentially cylindrical housing encompassing the lighting module 102. The guiding pins 114 arranged on the outside of an essentially cylindrical portion of the lighting module 102 are configured to fit in corresponding guiding slots 116 arranged on the inside of the connector 104. Alternatively, the guiding pins may be arranged on the connector in which case the guiding slots are arranged in the lighting module. The guiding pins 114 and guiding slots 116 keeps the lighting module and the connector together and they also allows the connector 104 to rotate and move in an axial direction in relation the lighting module 102. Only as much rotation and axial movement as is needed for installation of the lighting assembly 100 into the socket 150 is allowed. The guiding slots 116 may also have a rib for holding the guiding pins 114 and thereby the connector 104 in the correct position for mounting in the socket 150. Furthermore, spring means, here in the form of leaf springs 118, are arranged on a lower portion of the connector 104. The connector is also equipped with fastening pins 119 forming the male portion of a bayonet coupling for fastening the lighting assembly 100 to the socket 150.

Moreover, the collar shaped portion 120 of the socket 150 is equipped with receiving contacting means 122 in the form of openings for axially receiving the connector pins 108. The socket also has L-shaped recesses 124 forming the female portion of a bayonet coupling for fastening the lighting assembly 100 to the socket 150. The socket 150 also has features in the form of openings 126 for screwing the collar shaped portion 120 of the socket 150 to the heat sink 140.

Figure 2A:
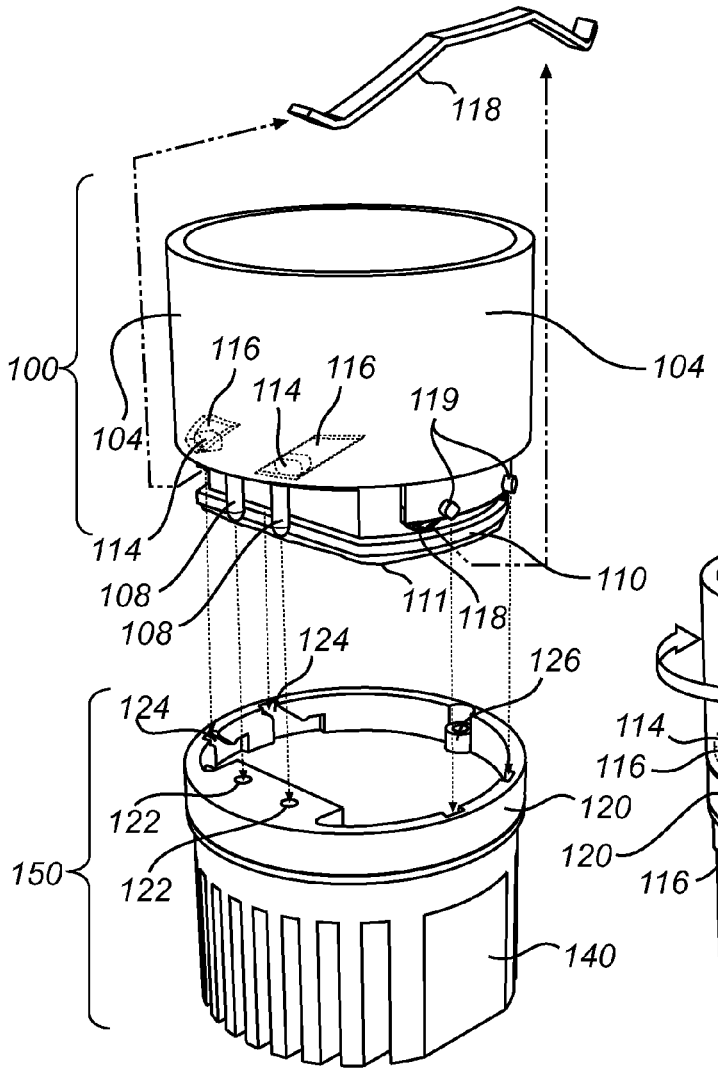
FIGS. 2*a* and 2*b* schematically illustrates a lighting assembly according to an embodiment of the present invention.
Figure 2B:
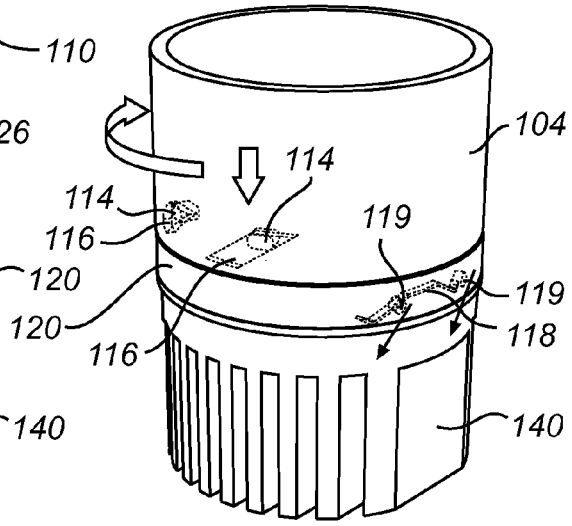

FIGS. 2*a* and 2*b* illustrate the mounting of the lighting assembly 100 into the socket 150. First, the lighting assembly 100 is axially inserted into the socket 150. The form of the opening in collar shaped portion 120 of the socket 150 corresponds to the form of the heat spreader 110 and the connector pins 108 are thereby correctly aligned to be axially inserted into the receiving contacting means 122. Simultaneously, the fastening pins 119 are axially inserted into the L-shaped recesses 124, together forming a bayonet coupling.

Next, a rotational motion of the connector 104 in relation to the socket 150 and in relation to the lighting module 102 closes the bayonet coupling, simultaneously moving the connector 104 in the axial direction in relation to the socket 150 and the lighting module towards the heat sink 140. As the connector 104 is moved towards the heat sink 140, the leaf springs 118 in the connector 104 apply a force on the heat spreader 110 in the axial direction, thereby pressing the heat spreader 110 against the heat sink 140 forming a good thermal contact. Since the heat spreader 110 is fixed to the lighting module 102, the lighting module is also moved in the axial direction in relation to the connector, this combined rotational and axial movement of the lighting module in relation to the connector is controlled by the guiding slots 116 in the connector and the corresponding guiding pins 114 in the lighting module.

Figure 3:
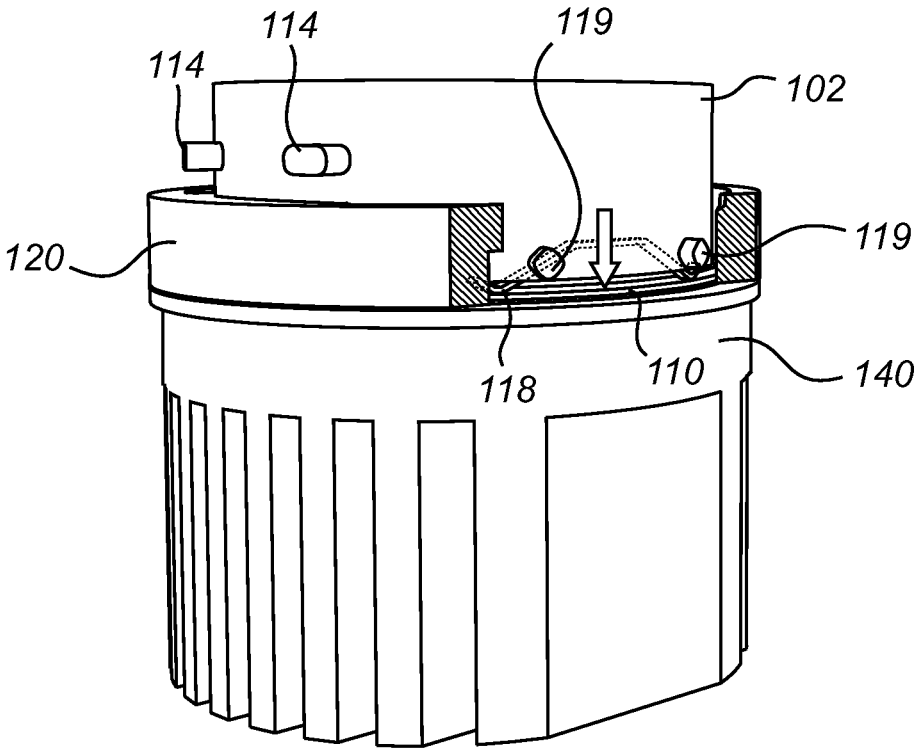
FIG. 3 schematically illustrates a portion of a lighting assembly according to an embodiment of the present invention.

FIG. 3 schematically illustrates the lighting module 102 mounted in the socket wherein the spring means 118 are applying a force in the vertical direction on the heat spreader 110, pressing the heat spreader 110 against the heat sink 140, thereby acting to form a good thermal contact between the heat spreader 110 and the heat sink 140.

The person skilled in the art realizes that the present invention by no means is limited to the preferred embodiments described above. On the contrary, many alterations, modifications and variations are possible within the scope of the appended claims. For example, other solid state light sources than LEDs may be used, e.g. lasers or laser diodes. Further, the connector may be used for any electrical interface, being an AC mains voltage, a low voltage AC voltage or a DC voltage. Additionally, the mechanical connection may be made in other ways such as by using screw threads.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lighting assembly configured to be mechanically and electrically connected to a socket, the lighting assembly comprising:

a lighting module comprising a first side and a second side, a light source, electrical contacting means electrically connected to the light source, a heat spreader in thermal contact with the light source and a pair of guiding pins; and a connector being rotatable in relation to the lighting module and comprising:

a pair of guiding slots, wherein each guiding slot of the pair of guiding slots is configured to hold and guide one of the pair of guiding pins from a first position to a second position within the respective one of the pair of guiding slots when the lighting module is axially inserted into the socket and the connector is rotated relative to the lighting module and socket; and a connector locking means for locking the lighting assembly to the socket through interaction with receiving locking means comprised in the socket when the lighting module is axially inserted into the socket and the connector is rotated relative to the lighting module and socket, thereby bringing the electrical contacting means into contact with corresponding receiving contacting means comprised in the socket, wherein the connector is positioned over the lighting module from the first side, the socket is positioned on the second side, and the connector encompasses at least a portion of the lighting module including the light source.

2. The lighting assembly according to claim 1, wherein the connector further comprises spring means arranged and configured to apply a mechanical force on the heat spreader in an axial direction so as to form a thermal contact between the heat spreader and a heat sink comprised in the socket.

3. The lighting assembly according to claim 1 wherein the electrical connection between the lighting module and the socket is achieved through the rotation of the connector and the resulting axial movement of the electrical contacting means such that no electrical connection is made unless the heat spreader is in thermal contact with the heat sink comprised in the socket.

4. The lighting assembly according to claim 3, wherein the light source is a light emitting diode.

5. The lighting assembly according to claim 4, wherein the connector locking means is a first part of a bayonet coupling.

6. The lighting assembly according to any one of claim 5, wherein the receiving locking means is a second part of a bayonet coupling.

7. A luminaire comprising a lighting assembly according to claim 5.

8. The lighting assembly according to claim 1 wherein the socket further comprises:

a collar shaped portion comprising the receiving locking means configured to interact with the connector locking means for locking the lighting assembly to the socket;

the receiving contacting means, for axially receiving the electrical contacting means of the lighting module; and a heat sink configured to form a thermal contact to the heat spreader.

9. The lighting assembly according to claim 8, wherein the collar shaped portion is mechanically connected to the heat sink.

10. The lighting assembly according to claim 9, wherein the receiving contacting means are arranged in the collar shaped portion.

11. The lighting assembly according to claim 8, wherein the collar shaped portion is arranged along the circumference of the socket.

* * * * *